US007583242B2

(12) United States Patent
Lee et al.

(10) Patent No.: US 7,583,242 B2
(45) Date of Patent: Sep. 1, 2009

(54) PLASMA DISPLAY PANEL, AND APPARATUS AND METHOD FOR DRIVING THE SAME

(75) Inventors: Soo-Jin Lee, Suwon-si (KR); Im-Su Choi, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 735 days.

(21) Appl. No.: 10/968,163

(22) Filed: Oct. 20, 2004

(65) Prior Publication Data

US 2005/0088372 A1 Apr. 28, 2005

(30) Foreign Application Priority Data

Oct. 23, 2003 (KR) ..... 10-2003-0074235

(51) Int. Cl.
*G09G 3/28* (2006.01)

(52) U.S. Cl. ..... 345/63; 345/690

(58) Field of Classification Search ..... 345/690, 345/63, 60, 68

See application file for complete search history.

(56) References Cited

U.S. PATENT DOCUMENTS

| | | | | |
|---|---|---|---|---|
| 6,614,413 | B2 * | 9/2003 | Tokunaga et al. | 345/63 |
| 7,053,868 | B1 * | 5/2006 | Kojima et al. | 345/60 |
| 7,161,607 | B2 * | 1/2007 | Choi | 345/690 |
| 2003/0193451 | A1 * | 10/2003 | Kimura | 345/60 |

FOREIGN PATENT DOCUMENTS

| | | |
|---|---|---|
| JP | 07-038778 | 2/1995 |
| JP | 08-194450 | 7/1996 |
| JP | 10-124003 | 5/1998 |
| JP | 2000-259118 | 9/2000 |
| JP | 2001-092409 | 4/2001 |
| JP | 2002-032052 | 1/2002 |
| JP | 2002-044681 | 8/2002 |
| JP | 2002-358045 | 12/2002 |
| JP | 2003-015584 | 1/2003 |
| JP | 2003-015588 | 1/2003 |
| JP | 2003-177701 | 6/2003 |
| KR | 10-2003-0017222 | 3/2003 |
| KR | 10-2003-0081151 | 10/2003 |
| KR | 10-2003-0088295 | 11/2003 |

* cited by examiner

*Primary Examiner*—Sumati Lefkowitz
*Assistant Examiner*—Seokyun Moon
(74) *Attorney, Agent, or Firm*—H.C. Park & Associates, PLC

(57) ABSTRACT

Disclosed is a plasma display panel, and an apparatus and method for driving the same. In the method of the present invention, an image signal is received and gamma-corrected according to a gamma correction curve. The gamma-corrected image signal is generated as subfield data according to a compressed subfield generation table. The average signal level of the image signal is calculated and correction according to an average signal level correction inverse curve is performed regarding the generation of the subfields for each gray level, and a sustain electrode driving signal and a scan electrode driving signal corresponding to the average signal level are output.

8 Claims, 9 Drawing Sheets

| SF | SF0 | SF1 | SF2 | SF3 | ··· | ··· | SF10 | sum |
|---|---|---|---|---|---|---|---|---|
| 1LSB(prior art) | 4 | 8 | 16 | 24 | ··· | ··· | ··· | 1024 |
| 0.5 LSB | 2 | 4 | 8 | 16 | ··· | ··· | ··· | 1024 |
| 0.25 LSB | 1 | 3 | 7 | 15 | ··· | ··· | ··· | 1020 |

| Gray Level Step | 1LSB | 0.5LSB | 0.25LSB |
|---|---|---|---|
| 1 | 4 | 2 | 1 |
| 2 | 8 | 4 | 3 |
| 3 | 12 | 6 | 4 |
| 4 | 16 | 8 | 7 |
| 5 | 20 | 10 | 8 |
| ⋮ | ⋮ | ⋮ | ⋮ |

irregular increase of luminance

FIG.6

| System | low load image | high load image | remark |
|---|---|---|---|
| 1LSB (prior art) | color stripe of white gray bar occurs due to excessive unit light (great step between the gray levels) | excessive color stripe occurs when small sustain number, i.e. high load | quantization error according to method of generating sustain number at each SF by inner calculation is great at LSB side |
| 0.5LSB | color stripe at low gray level is lower than 1LSB (Step between gray levels is 1/2 of 1LSB) | more color stripe than 1LSB | quantization error becomes greater as the sustain number of LSB becomes small |
| 0.25LSB | irregular increase of gray level excessive color stripe | more color stripe than 0.5LSB | quantization error becomes greater as the sustain number of LSB becomes small |

PLASMA DISPLAY PANEL, AND APPARATUS AND METHOD FOR DRIVING THE SAME

CROSS REFERENCE TO RELATED APPLICATION

This application claims priority to and the benefit of Korean Patent Application No. 10-2003-0074235, filed on Oct. 23, 2003, which is hereby incorporated by reference for all purposes as if fully set forth herein.

BACKGROUND OF THE INVENTION

1. Field of the Invention

The present invention relates to a plasma display panel (PDP), and more particularly, to an apparatus and a method for driving the PDP.

2. Discussion of the Related Art

Flat panel displays, such as a liquid crystal displays (LCD), field emission displays (FED), and PDPs, have been developed recently. Generally, as compared to other flat panel displays, the PDP is brighter, has a higher light emitting efficiency and a wider viewing angle. Thus, the PDP is recognized as a substitute for the conventional cathode ray tube (CRT), especially for large displays of greater than forty inches.

The PDP displays characters or images with plasma generated by gas discharge, and depending upon its size, it may have hundreds of thousands or millions of pixels arranged in a matrix. A PDP is typically classified as a direct current (DC) or an alternating current (AC) type PDP according to its discharge cell structure and driving voltage waveform shape.

The DC PDP has a shortcoming in that current flows in a discharge space when voltage is applied to electrodes in the discharge space, which requires a resistor for restricting the current. To the contrary, the current in the AC DDP is restricted by naturally formed capacitance components, and the electrodes are protected from the impact of ions during discharge because they are covered with a dielectric layer, which results in the AC PDP having a longer lifespan than the DC PDP.

FIG. 1 is a partial perspective view of a conventional AC PDP.

As shown in FIG. 1, pairs of scan electrodes 4 and sustain electrodes 5, covered by a dielectric layer 2 and a protection layer 3, are formed parallel on a first substrate 1. A plurality of address electrodes 8, covered by an insulation layer 7, is formed on a second substrate 6. Barrier ribs 9 are formed in parallel with, and between, the address electrodes 8 on the insulation layer 7. Further, phosphors 10 are formed on the surface of the insulation layer 7 and both sides of the barrier ribs 9. The first substrate 1 and the second substrate 6 are sealed together to form a discharge space 11 between them and in such a manner that the scan electrodes 4 and the sustain electrodes 5 are perpendicular to the address electrodes 8. A portion of the discharge space 11 between a crossing of the address electrode 8 and a pair of the scan electrode 4 and the sustain electrode 5 forms a discharge cell 12.

FIG. 2 shows a tri-electrode plane discharge structure of the PDP.

In such a structure, a discharge for forming a wall charge to select a pixel occurs between an address electrode and a scan electrode, and then a discharge for displaying the image occurs repeatedly for a certain period of time between the scan electrode and the sustain electrode.

A wall charge means a charge formed on a wall, such as at the dielectric layer of a discharge cell, near the respective electrodes and accumulated on the electrodes. Such a wall charge does not actually contact the electrodes, but rather it is described as being "formed", "accumulated", or "piled" on the electrodes. Wall voltage means an electric potential difference formed on the wall of the discharge cell by the wall charge.

The barrier ribs form the discharge space and block light generated by a discharge, in order to prevent cross-talk with neighboring pixels. The PDP displays desired colors by making discharges in the pixels, which generate ultra violet rays that excite the phosphors to emit light.

A middle gray level should be realized in order for the PDP to adequately function as a color display, and a method for displaying a middle gray level using time-division control has been used.

FIG. 3 shows a 6 bit gray level realizing method for an AC PDP, in which one TV field is divided to six subfields $SF_1$-$SF_6$, and each of the subfields is further divided into an address period $A_1$-$A_6$ and a display discharge sustain period $S_1$-$S_6$.

However, when using the conventional gray level expressing method with N subfields, a color stripe may occur at low and high gray levels due to excessive unit light.

SUMMARY OF THE INVENTION

The present invention provides a PDP, and an apparatus and method for driving the PDP, with an enhanced ability to express a unit gray level while maintaining linearity of the gray level and the brightness.

Additional features of the invention will be set forth in the description which follows, and in part will be apparent from the description, or may be learned by practice of the invention.

The present invention discloses an apparatus for driving a plasma display panel, comprising a gamma corrector, a subfield data generator, an average signal level calculator, and an automatic power controller.

The gamma corrector receives an image signal and performs a gamma correction according to a gamma correction curve.

The subfield data generator generates the image signal output from the gamma corrector as subfield data, according to a subfield generating compression curve, and outputs the subfield data as an address electrode driving signal.

The average signal level calculator calculates the average signal level of the image signal output from the gamma corrector and performs a correction according to an average signal level correction inverse curve regarding to a generation of subfields for each gray level.

The automatic power controller applies a sustain electrode driving signal and a scan electrode driving signal corresponding to the average signal level.

The present invention also discloses an apparatus for driving a plasma display panel, comprising a gamma corrector and a subfield data generator.

The gamma corrector receives an image signal and performs a gamma correction according to a gamma correction curve.

The subfield data generator generates subfield data from the image signal output from the gamma corrector according to a subfield generating compression curve and outputs the subfield data as an address electrode driving signal.

The present invention also discloses a plasma display panel (PDP) comprising a controller, an address electrode driver, a sustain electrode driver, and a scan electrode driver.

The PDP includes a plurality of address electrodes, and a plurality of scan electrodes and sustain electrodes arranged in pairs.

The controller corrects the image signal input thereto according to a gamma correction, generates subfield data according to a subfield generating compression curve, and outputs the subfield data as an address electrode driving signal. The controller also calculates an average signal level of the gamma-corrected image signal, performs correction according to an average signal level correction inverse curve regarding generation of subfields for each gray level, and outputs a sustain electrode driving signal and a scan electrode driving signal corresponding to the corrected average signal level.

The present invention also discloses a method for driving a plasma display panel.

In the method, an image signal is gamma corrected according to a gamma correction curve.

The gamma-corrected image signal is generated as subfield data according to a subfield generating compression curve, and the subfield data are output as an address electrode driving signal.

An average signal level of the gamma-corrected image signal is calculated and a correction is performed according to an average signal level correction inverse curve regarding a generation of subfields for each gray level.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

FIG. 6 shows the comparison results of the ability to express the gray level and frequency of generation of a color stripe with the nonlinear gray level of a 0.5 gray level and a 0.25 gray level.

DETAILED DESCRIPTION OF THE PREFERRED EMBODIMENTS

In the following detailed description, preferred embodiments of the invention are shown and described, simply by illustrating the best mode contemplated by the inventors of carrying out the invention. The invention can be modified in various obvious respects, all without departing from the invention. Accordingly, the drawings and description are to be regarded as illustrative in nature, and not restrictive.

Hereinafter, exemplary embodiments of the present invention will be described in detail with reference to the accompanying drawings.

Figure 1:
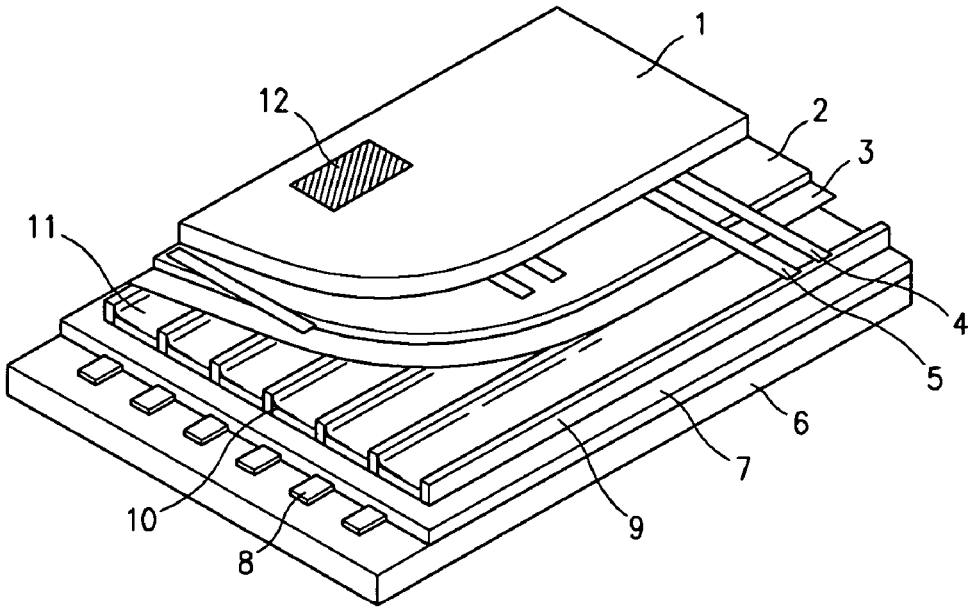
FIG.1 (Prior Art)
FIG. 1 is a partial perspective view of an AC PDP.
Figure 2:
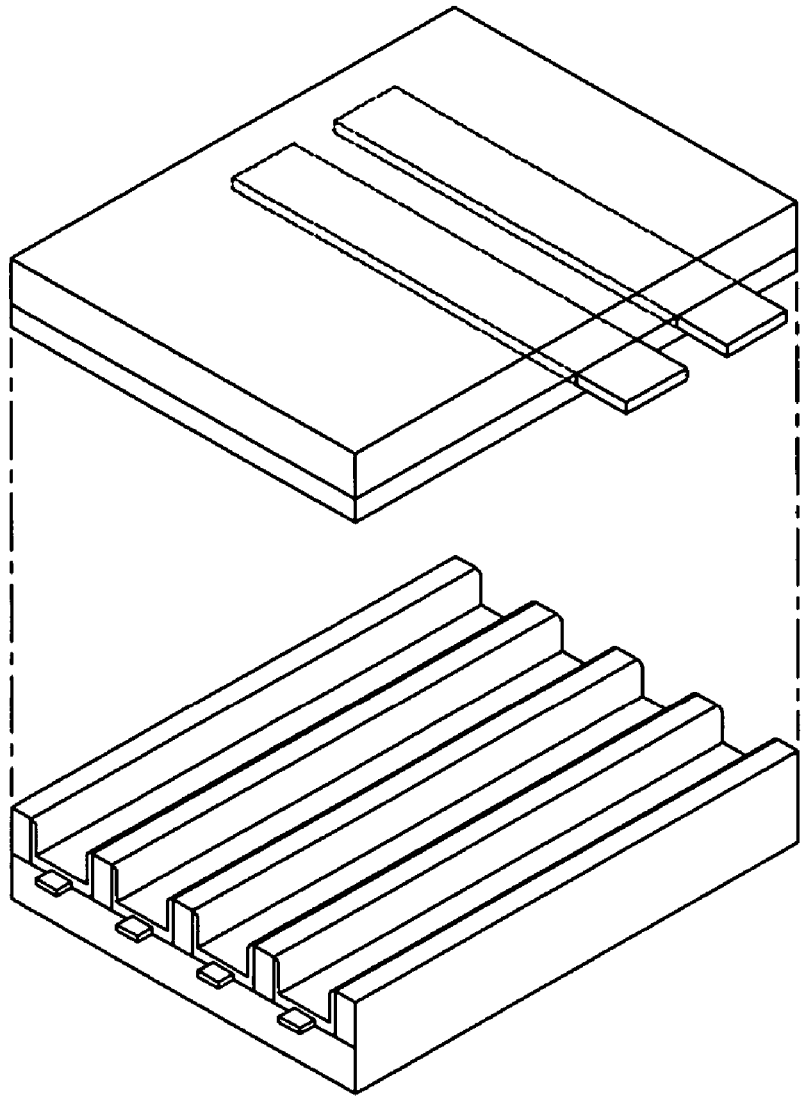
FIG.2 (Prior Art)
FIG. 2 shows a typical tri-electrode plane discharge structure of the AC PDP of FIG. 1.
Figure 3:
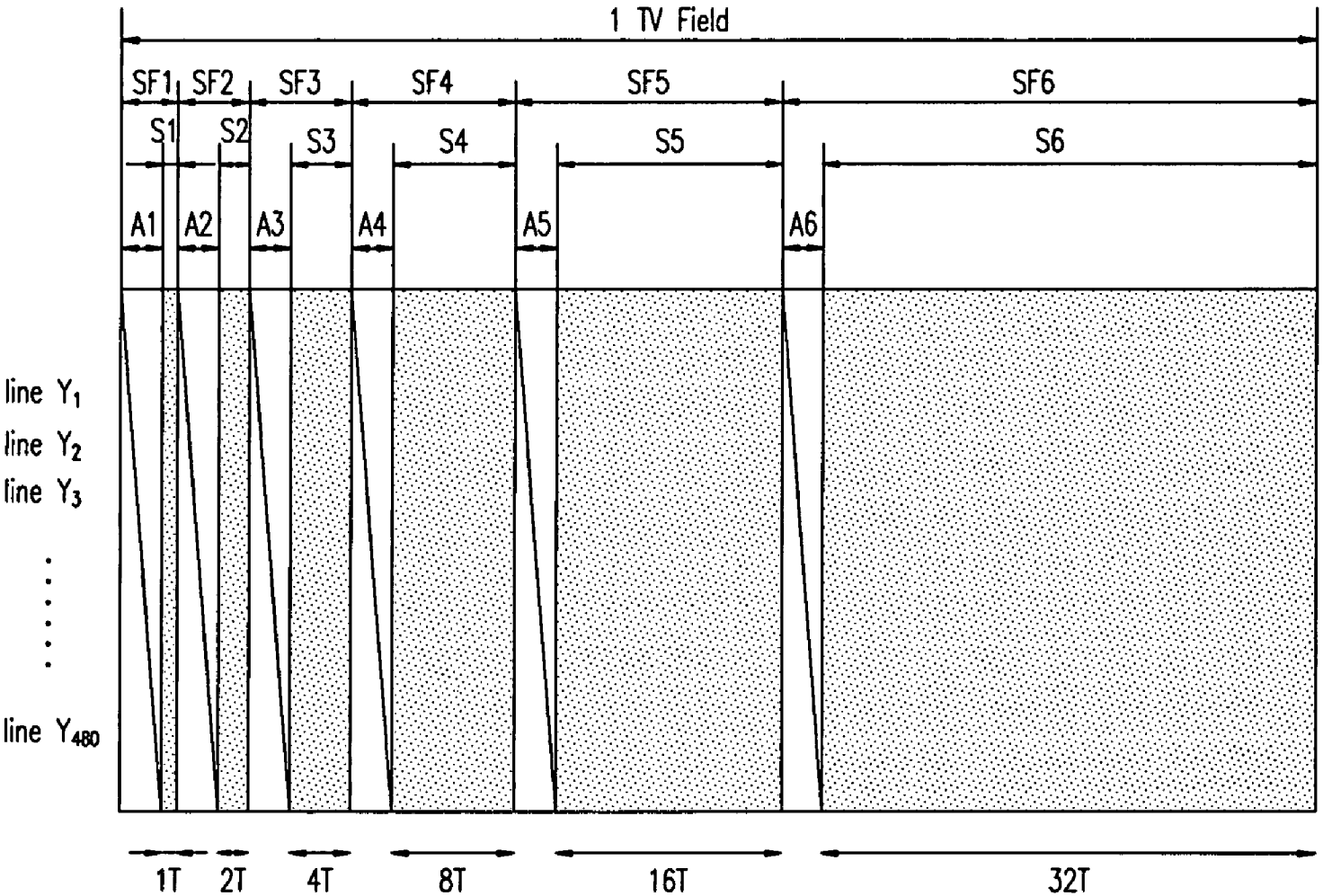
FIG.3 (Prior Art)
FIG. 3 shows a general middle gray level realizing method for the AC PDP of FIG. 1.
Figures 4, 5:
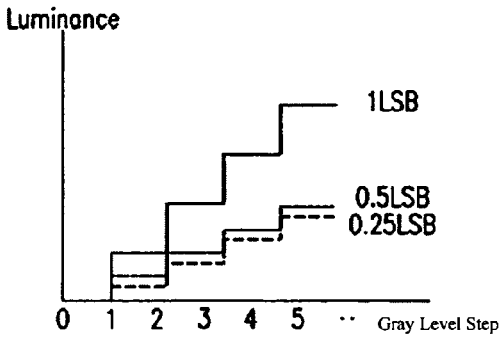
FIG. 4 shows the sustain weight of a 0.5 gray level and a 0.25 gray level at each subfield according to the first exemplary embodiment of the present invention.
FIG. 5 shows the results of a comparison of unit light intensity.

FIG. 4 shows the sustain weight of a 0.5 gray level and a 0.25 gray level at each subfield according to the first exemplary embodiment of the present invention.

Referring to FIG. 4, the subfield weight (SF weight) is adjusted in order to reduce the intensity of a unit gray level light.

In the first exemplary embodiment, among N members of SFs, one SF with half the number of sustain pulses of a least significant bit (LSB) is made and added so as to express a 0.5 gray level (0.5 LSB).

In order to further reduce the intensity of a unit gray level light, one SF with half the number of sustain pulses a 0.5 LSB is made to express a 0.25 gray level (0.25 LSB).

According to the first exemplary embodiment having the sustain weight of 0.5 LSB/0.25 LSB as shown in FIG. 4, the ability to express the low gray level may be enhanced as the intensity of a unit gray level light decreases, but nonlinearity of gray level occurs.

FIG. 5 shows the result of comparison of unit light intensity between the prior art (1 LSB) and the first exemplary embodiment, in which the 0.25 LSB provides for an irregular increase of the gray level, thereby resulting in an irregular increase in luminance.

FIG. 6 shows the comparison result of the ability to express the gray level and frequency of generation of color stripes between the linear gray level of 1 LSB and the nonlinear gray level of 0.5 LSB/0.25 LSB.

Referring to FIG. 6, the gray level expression is improper at low and high loads because the gray level is nonlinear in the first exemplary embodiment.

In order to amend this nonlinearity, the second exemplary embodiment performs Compressed Subfield Generation Table (SF-Gen Table) mapping, i.e. nonlinear data mapping.

Since the number of gray levels that may be assigned for SF-Gen Table mapping is restricted, there may be many assigned low gray levels and few assigned high gray levels in the second exemplary embodiment.

A nonlinear SF-Gen Table in which 512 outputs are compressed to 256 outputs is applied to the 0.5 LSB, and a nonlinear SF-Gen Table in which 1024 outputs are compressed to 256 outputs is applied to the 0.25 LSB.

Figure 7:
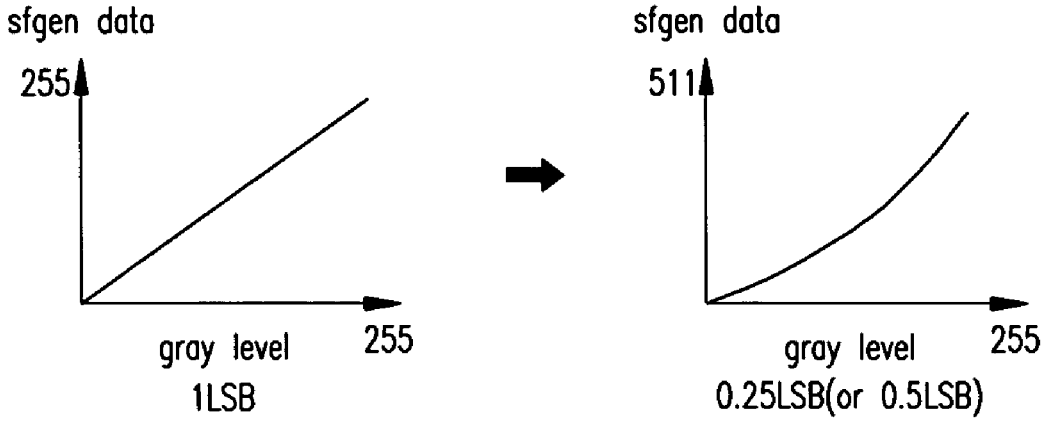
FIG. 7 shows the results of a comparison of subfield generation tables.

FIG. 7 shows the results of comparison of the SF-Gen Table between 1 LSB and 0.25 LSB (or 0.5 LSB) of the second exemplary embodiment of the present invention.

When applying the SF-Gen Table of FIG. 7, the luminance with respect to the input gray level is generated in accordance with SF-Gen Table with gamma off.

However, luminance nonlinearity may still occur when applying the Compressed SF-Gen Table according to the second exemplary embodiment.

Accordingly, in the third exemplary embodiment, the linear luminance characteristic may be achieved by amending the nonlinear luminance characteristic of the SF-Gen Table with a gamma correction curve at the gamma block.

Figure 8:
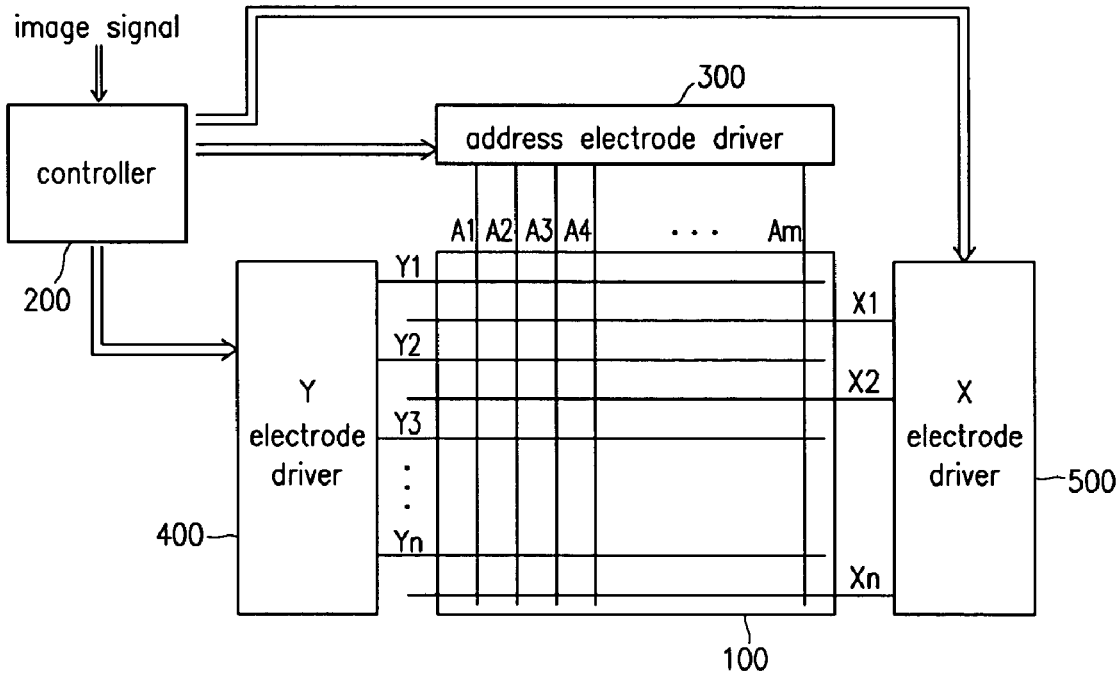
FIG. 8 is a block diagram of a PDP according to the third exemplary embodiment of the present invention.

FIG. 8 is a block diagram of the PDP according to the third exemplary embodiment of the present invention.

Referring to FIG. 8, the PDP includes a plasma panel 100, a controller 200, an address electrode driver 300, a scan ("Y") electrode driver 400, and a sustain ("X") electrode driver 500.

The plasma panel 100 includes a plurality of address electrodes $A_1$-$A_m$, arranged in a column direction, and a plurality of X electrodes $X_1$-$X_n$ and a plurality of Y electrodes $Y_1$-$Y_n$, arranged in a zigzag fashion in a row direction. The X electrodes $X_1$-$X_n$ correspond to the respective Y electrodes $Y_1$-$Y_n$. Further, the plasma panel 100 is comprised of a first glass substrate (not shown) on which the X and Y electrodes $X_1$-$X_n$ and $Y_1$-$Y_n$ are arranged, and a second glass substrate (not shown) on which the address electrodes $A_1$-$A_m$ are arranged. The two glass substrates are sealed together, with a discharge space between them, so that the X electrodes $X_1$-$X_n$ and the Y electrodes $Y_1$-$Y_n$ are perpendicular to the address electrodes $A_1$-$A_m$. Discharge spaces at the intersections between the address electrodes $A_1$-$A_m$ and the X and Y electrodes $X_1$-$X_n$ and $Y_1$-$Y_n$ form discharge cells.

The controller 200 gamma corrects the input image signal according to its stored gamma correction curve, generates subfield data according to the compressed subfield generation table, and outputs the subfield data as the address electrode driving signal. The controller 200 also calculates the average signal level (ASL) of the gamma-corrected image signal, performs a correction according to the ASL correction inverse curve regarding the generation of the subfields for each gray level, and outputs a sustain electrode driving signal and a scan electrode driving signal corresponding to the corrected ASL.

The address electrode driver 300 receives the address electrode driving signal from the controller 200 and applies a display data signal to the respective address electrodes $A_1$-$A_m$, thereby selecting the discharge cells to be displayed.

The X electrode driver 500 receives the X electrode driving signal from the controller 200, and applies a driving voltage to the X electrodes $X_1$-$X_n$.

The Y electrode driver 400 receives the Y electrode driving signal from the controller 200, and applies a driving voltage to the Y electrodes $Y_1$-$Y_n$.

Figure 9:
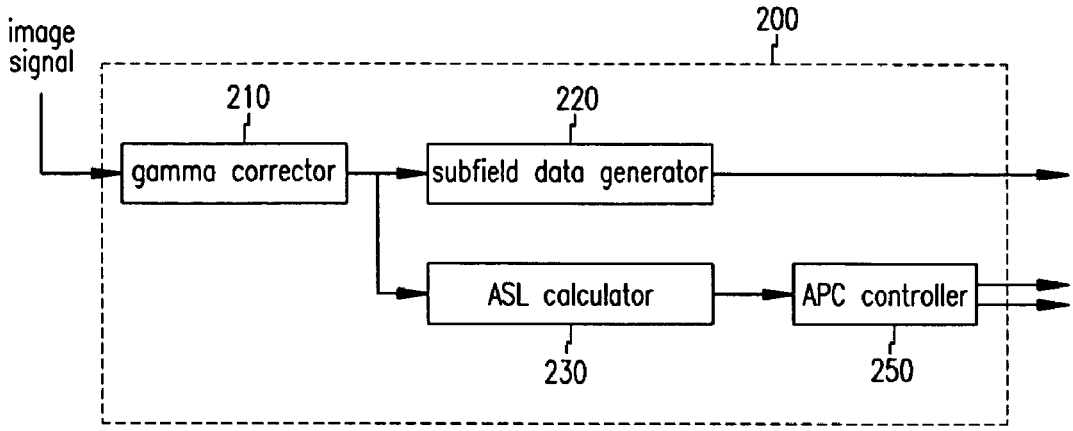
FIG. 9 shows the controller of FIG. 8.

FIG. 9 is a detailed view of the controller 200.

Referring to FIG. 9, the controller 200 is comprised of a gamma corrector 210 for receiving the image signal and gamma correcting it according to the gamma correction curve stored therein; a subfield data generator 220 for generating the subfield data according to the compressed subfield generation table and outputting the subfield data as the address electrode driving signal; an ASL calculator 230 for calculating the ASL of the image signal output from the gamma corrector and performing the correction according to the ASL correction inverse curve regarding the generation of the subfields for each gray level; and an automatic power controller (APC) 250 for applying a sustain electrode driving signal and a scan electrode driving signal corresponding to the ASL.

The operation of the PDP according to the third exemplary embodiment of the present invention will now be described in detail.

Figure 10:
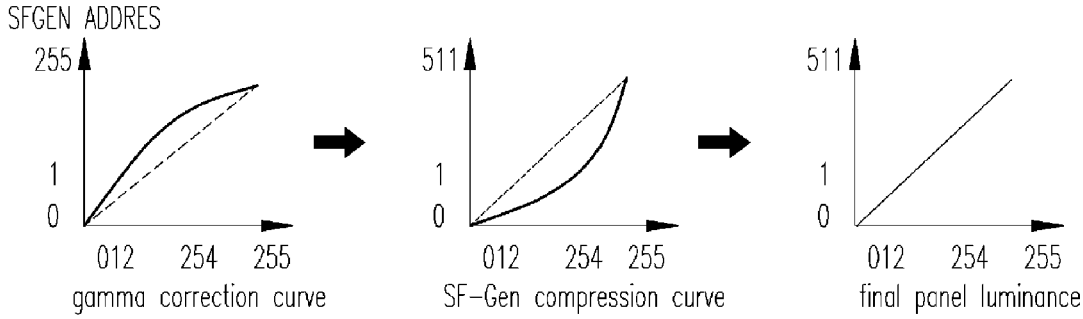
FIG. 10 shows a gamma correction curve and a subfield generating compression curve employed in the third exemplary embodiment of the present invention.

The gamma corrector 210 receives the input image signal, performs the gamma correction according to the gamma correction curve stored therein, as shown in FIG. 10, and outputs the correction result.

The subfield data generator 220 receives the image signal output from the gamma corrector 210, generates the subfield data according to the compressed SF-Gen Table stored therein, as shown in FIG. 10, and outputs the subfield data as the address electrode driving signal.

As shown in FIG. 10, the PDP has a final linear luminance characteristic because the gamma correction curve of the gamma corrector 210 corrects the nonlinear characteristic of the compressed SF-Gen Table.

Figure 11:
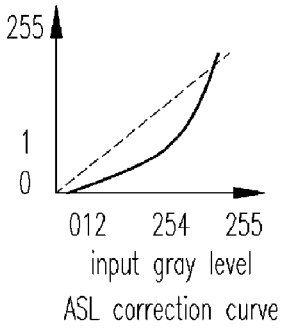
FIG. 11 shows an average signal level (ASL) correction curve and a subfield generating compression curve employed in the third exemplary embodiment of the present invention.

Additionally, the ASL calculator 230 calculates the ASL of the image signal and performs a correction according to the ASL correction inverse curve stored therein, as shown in FIG. 11.

The APC controller 250 then applies the sustain electrode driving signal and the scan electrode driving signal corresponding to the ASL.

In that situation, linear gray mapping is generally employed when the load ratio ASL of the image is calculated with the sum of the output data of the gamma corrector 210. But the SF-Gen Table, employed for the image data displayed on the screen, may cause a nonlinear relation between power consumption and the ASL. Accordingly, in order to maintain the linear relation between the ASL and the power consumption, the ASL correction inverse curve regarding the generation of the subfields at each gray level may be applied.

The address electrode driver 300 receives the address electrode driving signal from the subfield data generator 220, and applies the display data signal to the respective address electrodes $A_1$-$A_m$ to select the discharge cells to be displayed.

The X electrode driver 500 receives the X electrode driving signal from the APC controller 250 and applies the driving voltage to the X electrodes $X_1$-$X_n$, and the Y electrode driver 400 receives the Y electrode driving signal from the APC controller 250 and applies the driving voltage to the Y electrodes $Y_1$-$Y_n$.

Then, the image data is displayed on the plasma panel 100.

In the third exemplary embodiment of the present invention, the gamma corrector 210 corrects the nonlinearity of the subfield compression curve by performing the correction with the gamma correction curve, and the ASL calculator 230 maintains the linear relation of the power consumption to the ASL with the ASL correction inverse curve.

The gamma correction curve and the ASL correction inverse curve may be employed individually.

According to exemplary embodiments of the present invention, a PDP and an apparatus and method for driving the PDP are provided, in which dot noise may be reduced by reducing the unit gray level light, and the ability to express a low gray level may be enhanced by the reduction of light intensity per unit step.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a plurality of address electrodes, and a plurality of scan electrodes and sustain electrodes arranged in pairs;

a controller for:

performing a gamma correction on an image signal, generating subfield data according to a compressed subfield generation table and outputting the subfield data as an address electrode driving signal, calculating an average signal level of the gamma-corrected image signal and correcting the average signal level of the gamma-corrected image signal according to an average signal level correction inverse curve which has an inverse characteristic with respect to a gamma correction curve used for performing the gamma correction, and outputting a sustain electrode driving signal and a scan electrode driving signal corresponding to a corrected average signal level;

an address electrode driver for applying the address electrode driving signal to the address electrodes;

a sustain electrode driver for applying the sustain electrode driving signal to the sustain electrodes; and a scan electrode driver for applying the scan electrode driving signal to the scan electrodes, wherein correction with the average signal level correction inverse curve maintains linear power consumption.

2. The PDP of claim 1, wherein the controller includes:

a gamma corrector for gamma correcting the image signal according to the gamma correction curve;

a subfield data generator for generating the subfield data from the gamma corrected image signal according to the compressed subfield generation table and outputting the subfield data as the address electrode driving signal;

an average signal level calculator for calculating the average signal level of the gamma-corrected image signal and correcting the average signal level of the gamma-corrected image signal according to the average signal level correction inverse curve; and an automatic power controller for outputting the sustain electrode driving signal and the scan electrode driving signal corresponding to the average signal level.

3. The PDP of claim 2, wherein the gamma corrector corrects nonlinearity of the compressed subfield generation table.

4. The PDP of claim 1, wherein the controller includes:

a gamma corrector for gamma correcting the image signal according to a gamma correction curve stored therein; and a subfield data generator for generating subfield data from the gamma corrected image signal according to the compressed subfield generation table, and then outputting the subfield data as the address electrode driving signal.

5. An apparatus for driving a plasma display panel, comprising:

a gamma corrector for gamma correcting an image signal;

a subfield data generator for generating the image signal output from the gamma corrector as subfield data according to a compressed subfield generation table and outputting the subfield data as an address electrode driving signal;

an average signal level calculator for calculating the average signal level of the image signal output from the gamma corrector and performing a correction according to an average signal level correction inverse curve regarding a generation of subfields for each gray level, the average signal level correction inverse curve having an inverse characteristic with respect to a gamma correction curve used for performing the gamma correction; and an automatic power controller for applying a sustain electrode driving signal and a scan electrode driving signal corresponding to the average signal level, wherein the correction with the average signal level correction inverse curve maintains linear power consumption.

6. The apparatus of claim 5, wherein the gamma corrector corrects nonlinearity of the compressed subfield generation table by correcting with the gamma correction curve.

7. A method for driving a plasma display panel, comprising:

receiving an image signal and gamma correcting the image signal according to a gamma correction curve;

generating subfield data from the gamma-corrected image signal according to a compressed subfield generation table and outputting the subfield data as an address electrode driving signal;

calculating an average signal level of the gamma-corrected image signal and performing a correction according to an average signal level correction inverse curve regarding a generation of subfields for each gray level, the average signal level correction inverse curve having an inverse characteristic with respect to a gamma correction curve used for performing the gamma correction; and applying a sustain electrode driving signal and a scan electrode driving signal corresponding to the average signal level, wherein correction with the average signal level correction inverse curve maintains linear power consumption.

8. The method of claim 7, wherein nonlinearity of the compressed subfield generation table is corrected by gamma correcting.

* * * * *

UNITED STATES PATENT AND TRADEMARK OFFICE

CERTIFICATE OF CORRECTION

PATENT NO. : 7,583,242 B2
APPLICATION NO. : 10/968163
DATED : September 1, 2009
INVENTOR(S) : Lee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1331 days.

Signed and Sealed this

Fourteenth Day of December, 2010

David J. Kappos

David J. Kappos
*Director of the United States Patent and Trademark Office*